US005598797A

United States Patent [19]

Patterson

[11] Patent Number: 5,598,797

[45] Date of Patent: Feb. 4, 1997

[54] HAT EMBROIDERY POSITIONING DEVICE AND METHOD

[76] Inventor: Dennis W. Patterson, 867 August Way, Redding, Calif. 96003

[21] Appl. No.: 278,373

[22] Filed: Jul. 20, 1994

[51] Int. Cl.[6] ..... D05C 9/04

[52] U.S. Cl. ..... 112/103; 112/475.07; 112/475.11; 112/475.19; 38/102.2

[58] Field of Search ..... 112/103, 102.5, 112/470.06, 470.09, 470.14, 475.11, 475.09, 475.18, 475.19, 309, 155, 308, 318, 322, 63, 78, 475.07; 38/102.2

[56] References Cited

U.S. PATENT DOCUMENTS

| | | | |
|---|---|---|---|
| 4,598,488 | 7/1986 | Inteso | 112/103 |
| 4,762,076 | 8/1988 | Wakaizumi | 112/103 |
| 4,869,183 | 9/1989 | Moore III | 112/103 |
| 4,998,964 | 3/1991 | Golia | 112/103 X |
| 5,144,899 | 9/1992 | Allen | 112/103 |
| 5,415,116 | 5/1995 | Nishio | 112/103 |

*Primary Examiner*—Peter Nerbun
*Attorney, Agent, or Firm*—Coudert Brothers

[57] ABSTRACT

A hat embroidery alignment device and method comprises an alignment stand to which a cap frame with hat in place is located, thereby allowing an operator to draw forth a pointing device, or view a position indication, in order to align and lock the hat such that the area to be embroidered is positioned correctly, when placed onto an automatic sewing machine. The method of accurately prealigning the hat eliminates the need for final hat positioning while the cap frame is attached to the automatic sewing machine thereby saving labor.

10 Claims, 8 Drawing Sheets

HAT EMBROIDERY POSITIONING DEVICE AND METHOD

BACKGROUND OF THE INVENTION

In order to embroider hats and caps, it is necessary to position the hat, in a cap flame. The cap flame is used to hold the hat with the surface to be embroidered fixed in an opening, so that the surface is taught. Multiple cap flames are positioned onto an automatic sewing machine, and secured to allow the embroidery process to take place. The method, as commonly practiced in the industry is to first roughly position the hat into the cap flame, securing the bail. Secondly, the cap frames are secured to the automatic sewing machine. Lastly, each hat is re-adjusted in the cap frame, while affixed to the automatic sewing machine.

The initial rough positioning which is accomplished while the cap frame is detached from the automatic sewing machine is performed without any reference indication for locating the hat within the cap frame other than visual approximation. The act of re-positioning the hat, which takes place while the cap frame is secured to the sewing machine takes time, and makes it necessary for the sewing machine operator to bend down uncomfortably in order to make this final adjustment. The objective is to locate the hat such that the embroidered pattern is applied to the hat, in the correct location. Because this second adjustment is necessary, the operator unlocks the bail of the cap frame while the cap frame is locked onto the sewing machine, and repositions the hat, finally securing the bail. The readjustment means that the operator has performed hat adustment twice, a rough positioning when initially placing the hat on the cap frame, and then final positioning with the cap frame locked in place on the sewing machine. By positioning the hat in the cap frame initially, with a high degree of precision, the second positioning which takes place after the cap flames are locked on to the sewing machine, is eliminated, along with the associated labor and time. The cap frame, receiver and a post for supporting the open cap frame bail, are supplied by the manufacturer.

SUMMARY OF THE INVENTION

The subject device constitutes an alignment stand, which accepts the cap frame as it would be positioned on the automatic sewing machine, and a pointing device, which is preset to indicate the exact position for centering the hat. The alignment stand, allows the machine operator to align the hat in the cap frame while standing, prior to securing the cap frame to the sewing machine.

Once the cap frame is attached to the alignment stand, the pointing device is used to indicate the precise centerline of the embroidery work area so that the hat may be positioned properly in the cap frame. Or, in the embodiment of the invention where a light emitting device such as a laser is employed as the pointing device, the indication of the light beam is used as a reference for aligning the hat within the cap frame.

The actual pointing device and alignment stand, combination constitute the device sought to be patented. A variety of pointing means may be used such as a pointer, a light beam etc. Three embodiments are shown in the attached figures.

The method of prealigning the hat on the cap frame prior to placement of the cap frame onto the sewing machine is also claimed as part of the invention. Instead of the aforementioned three step process, whereby the hat is first roughly positioned onto the cap frame; secondly, secured in the sewing machine; and thirdly, readjusted again visually while secured to the sewing machine, the hat is precisely positioned onto the cap frame once, prior to placement onto the sewing machine, thereby eliminating the step of final positioning. The net result is a reduction of one step from the current method.. Experience shows that a previous process taking approximately ten minutes is reduced to about 6 minutes, with improved accuracy.

Other advantages of this invention will become clear from the following description taken in conjunction with the associated drawings wherein are set forth, by way of illustration and example, distinct embodiments of this invention.

The drawings are part of this specification and include exemplary embodiments of the present invention, illustrating various objects and features thereof.

DETAILED DESCRIPTION OF THE INVENTION

Figure 1:
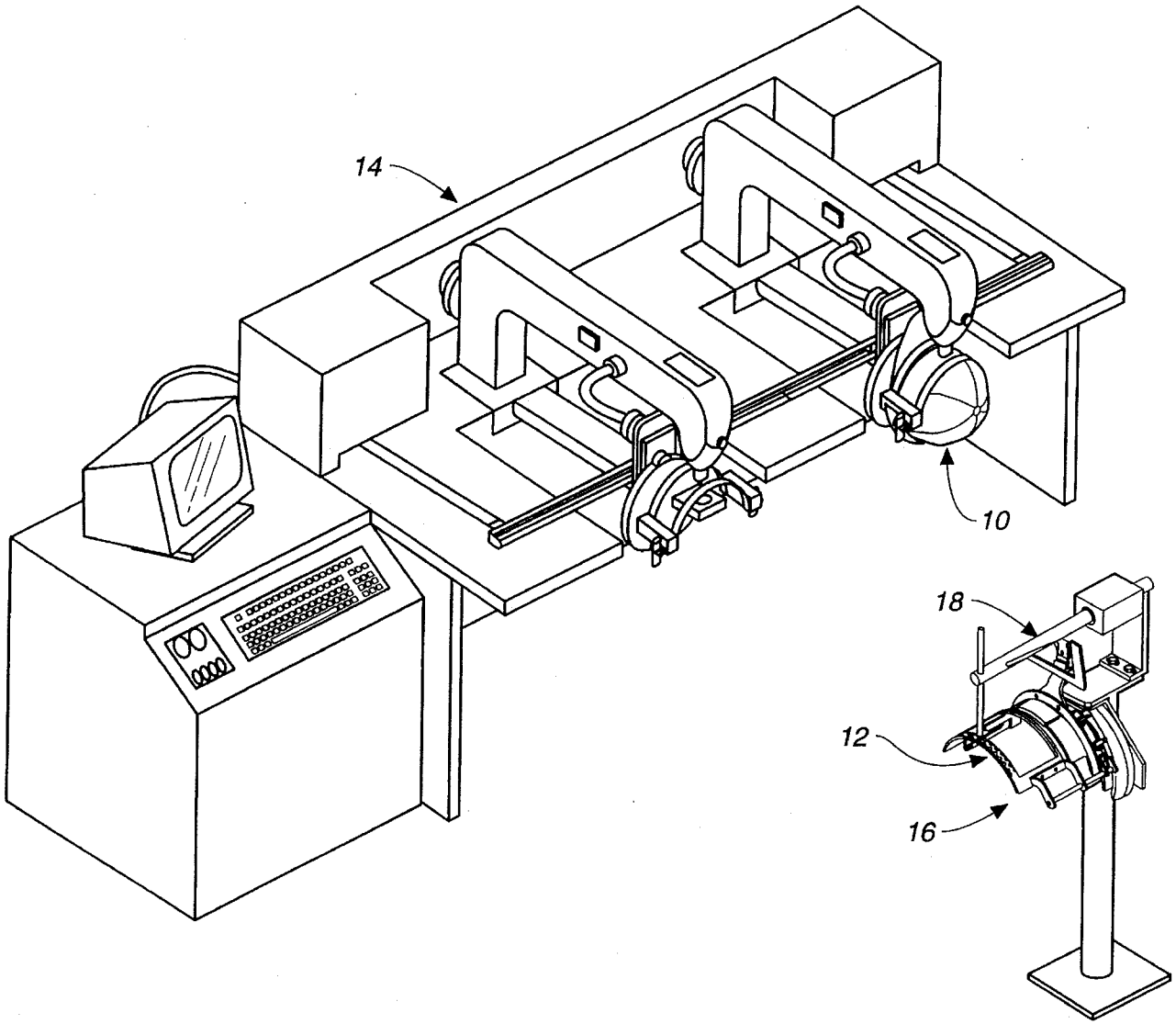
FIG. 1 is a perspective view of the alignment stand with the mechanical embodiment of the pointing device and a cap frame. Also in perspective is the automatic sewing machine with two cap frames affixed, one with a cap secured.

As required, detailed embodiments of the present invention are disclosed herein; however, it is to be understood that the disclosed embodiments are merely exemplary of the invention, which may be embodied in various forms. Consequently, details disclosed herein are not to be interpreted as limiting, but as merely a basis for the claims and as representations for teaching those skilled in the art to produce the invention in virtually any appropriately detailed structure.

The reference numeral 16 generally refers to an alignment stand in accordance with the present invention as shown in FIGS. 1 through 8. The indicating means, or pointing device, constructed of rigid material such as metal, plastic or wood, generally referred to as numeral 18 comprises a support block 25, pointer 22, and arm 31. The cap framing means, generally referred to as numeral 12, is as supplied by an automatic sewing machine manufacturer, such as a cap framing means like that marketed under the trademark TAJIMA TME-HC CAP SETTING FRAME® which encompasses the receiver 20, and has as part of it the cap frame mounting bracket 30. A post 21, likewise is provided by an automatic sewing machine manufacturer such as Tajima.

The alignment stand 16, constructed of aluminum, or some other suitable material, has a ranged base which may be fastened to a bench if so desired. The cap framing means 12, is mounted atop the alignment stand 16, by a fastening means 28. In the present invention, the same fastening means 28, is also employed to attach the angle bracket 24, of pointing device 18, as shown in FIG. 2A, to the cap frame 12, and alignment stand 16.

Figure 2:
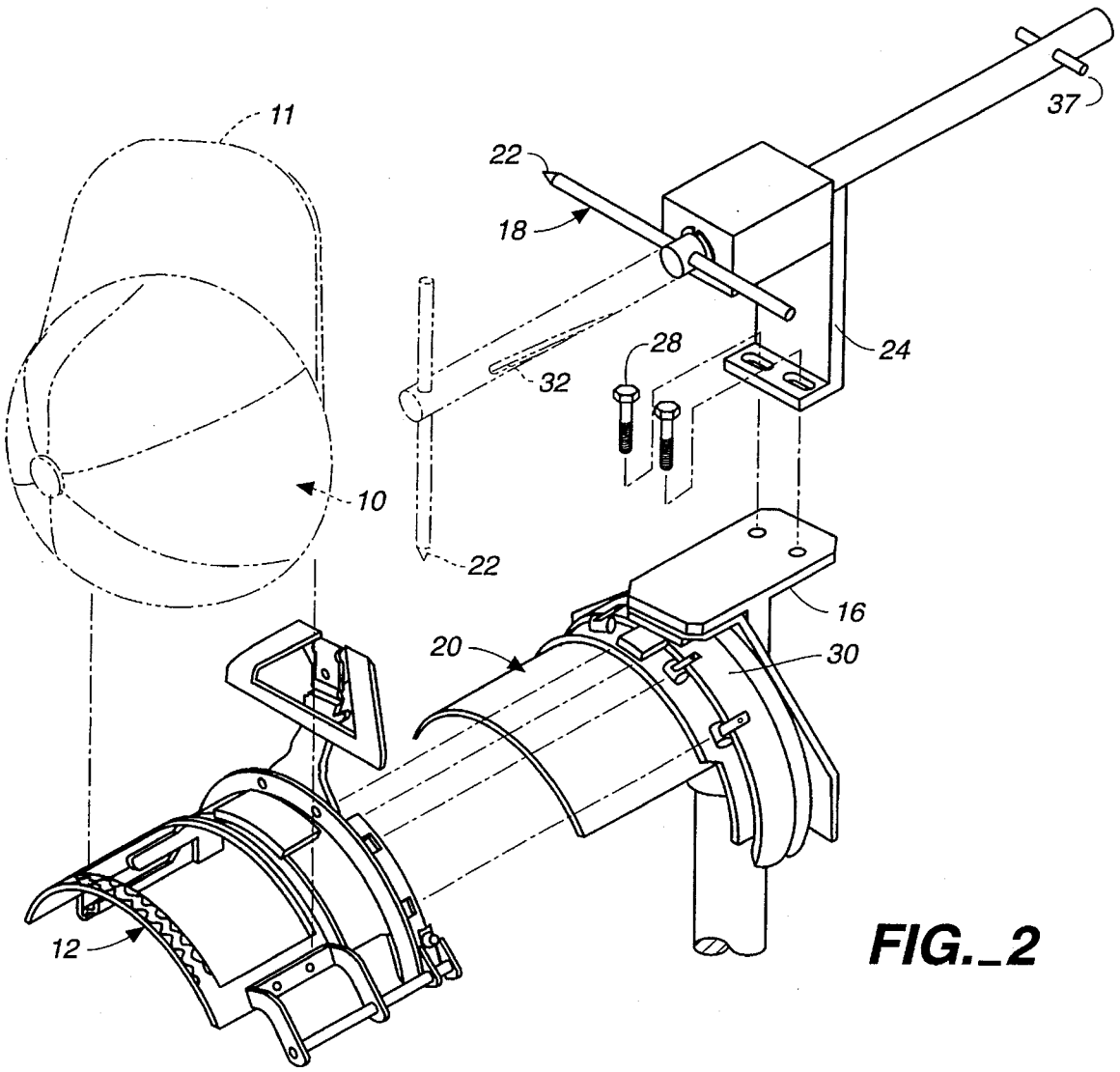
FIG. 2 shows an exploded view showing the alignment stand, cap frame and receiver, and the pointing device. The positioning of a hat in the cap frame is also shown.
Figure 2A:
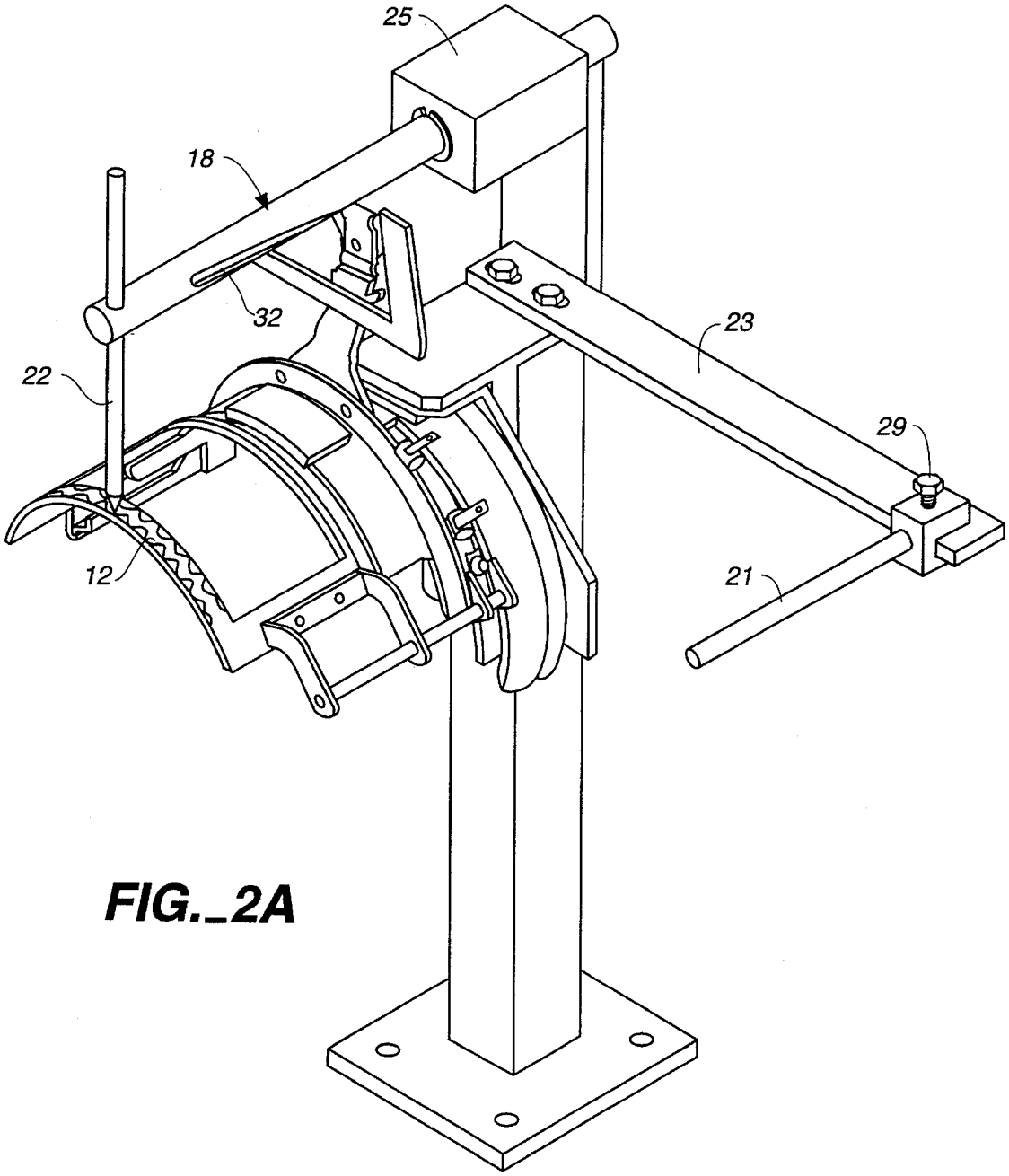
FIG. 2A is a perspective view of the assembled cap frame, receiver and alignment stand, in combination with the pointing device and an extension to the base of the pointing device, having a post for resting the cap frame when open.

The angle bracket 24, as shown in FIG. 2A has as part of its base a beam 23, which provides a means to support the post 21, which is in turn secured by a fastening means 29. Said beam 23, may be integral to the angle bracket 24, or could be a simple beam attached to the angle bracket 24 in combination with the alignment stand 16. Post 21 in the present invention comprises a manufacturer supplied part. The beam 23 could utilize other than a supplied post 21, to perform the same function of supporting the bail of cap frame 12, when adjusting or placing hat 10.

Fastening means 28 in the present invention utilizes two slots in the horizontal arm of angle bracket 24, through which two machine screws engage two threaded openings in the top of the alignment stand 16, thereby holding the combination firmly together. Other fastening means such as welding, bolts and wing nuts, or other suitable method may be employed to construct the combination. Fastening means 29 in the present invention constitutes a machine screw which engages a threaded hole in the "U" shaped end of post 21, thereby supplying compressive force against post support 23, securing post 21.

Figure 2B:
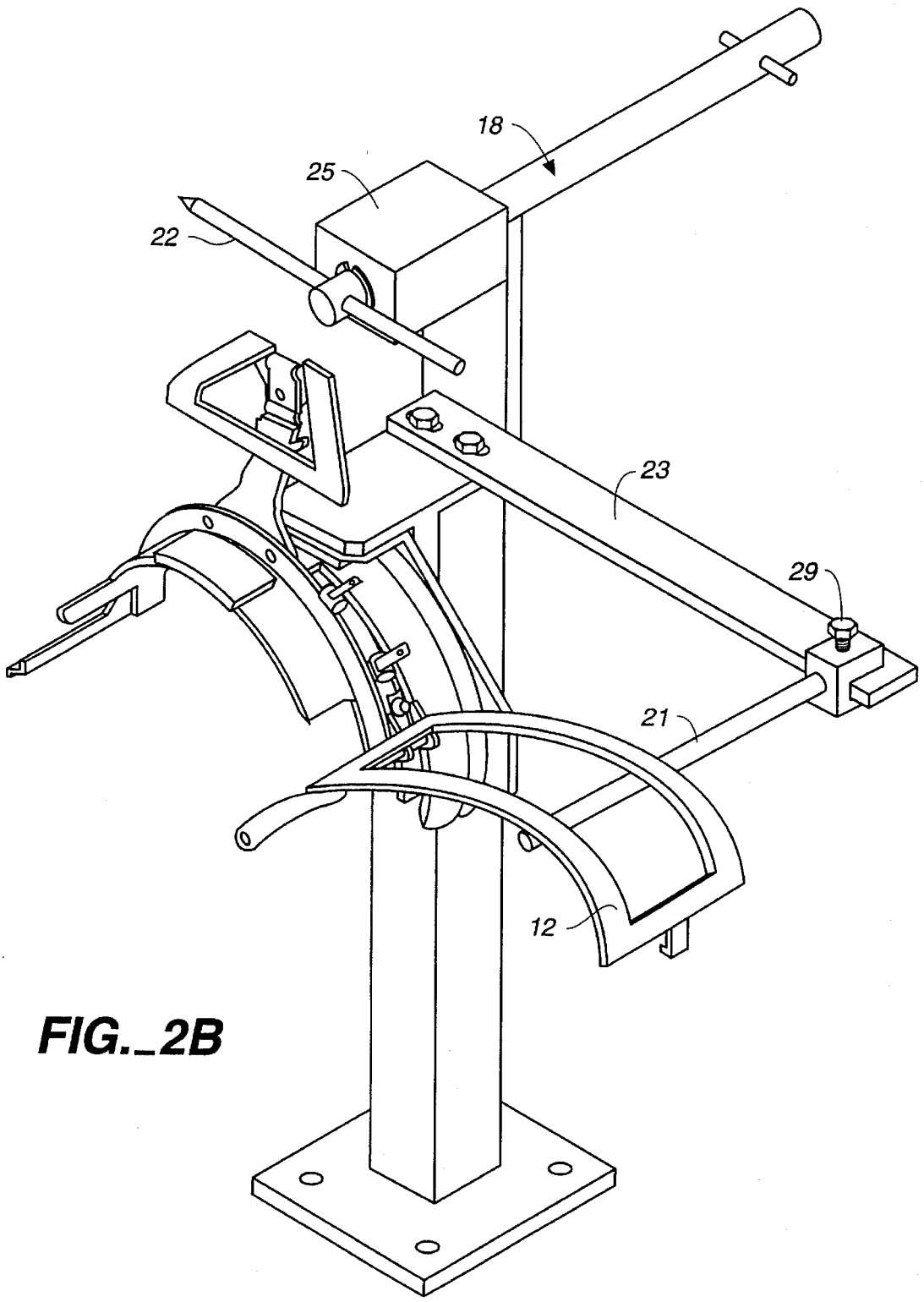
FIG. 2B is a perspective of the same assembly as in FIG. 2A showing the cap frame bail opened and resting on the post.
Figure 3:
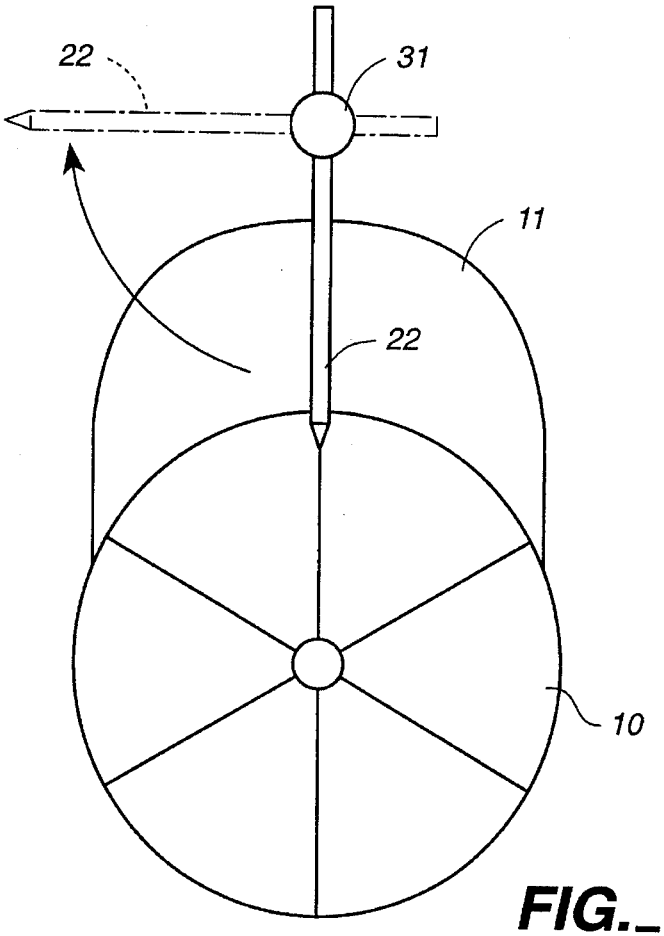
FIG. 3 illustrates the position of the pointer to the hat in both the retracted and drawn positions. The pointer is rotated in order to clear the cap bill when drawn into position.
Figure 5:
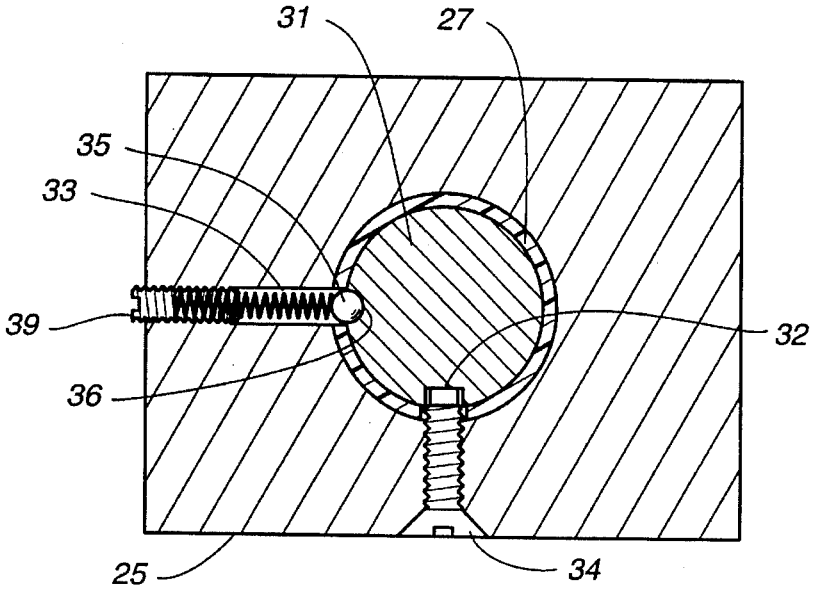
FIG. 5 is a cross section of the pointing device's support block showing the spiral groove and ball detent details. The ball is biased toward the arm by a spring, which is held in place by a set screw. The bearing sleeve through which the arm slides is shown in this figure.
Figure 4:
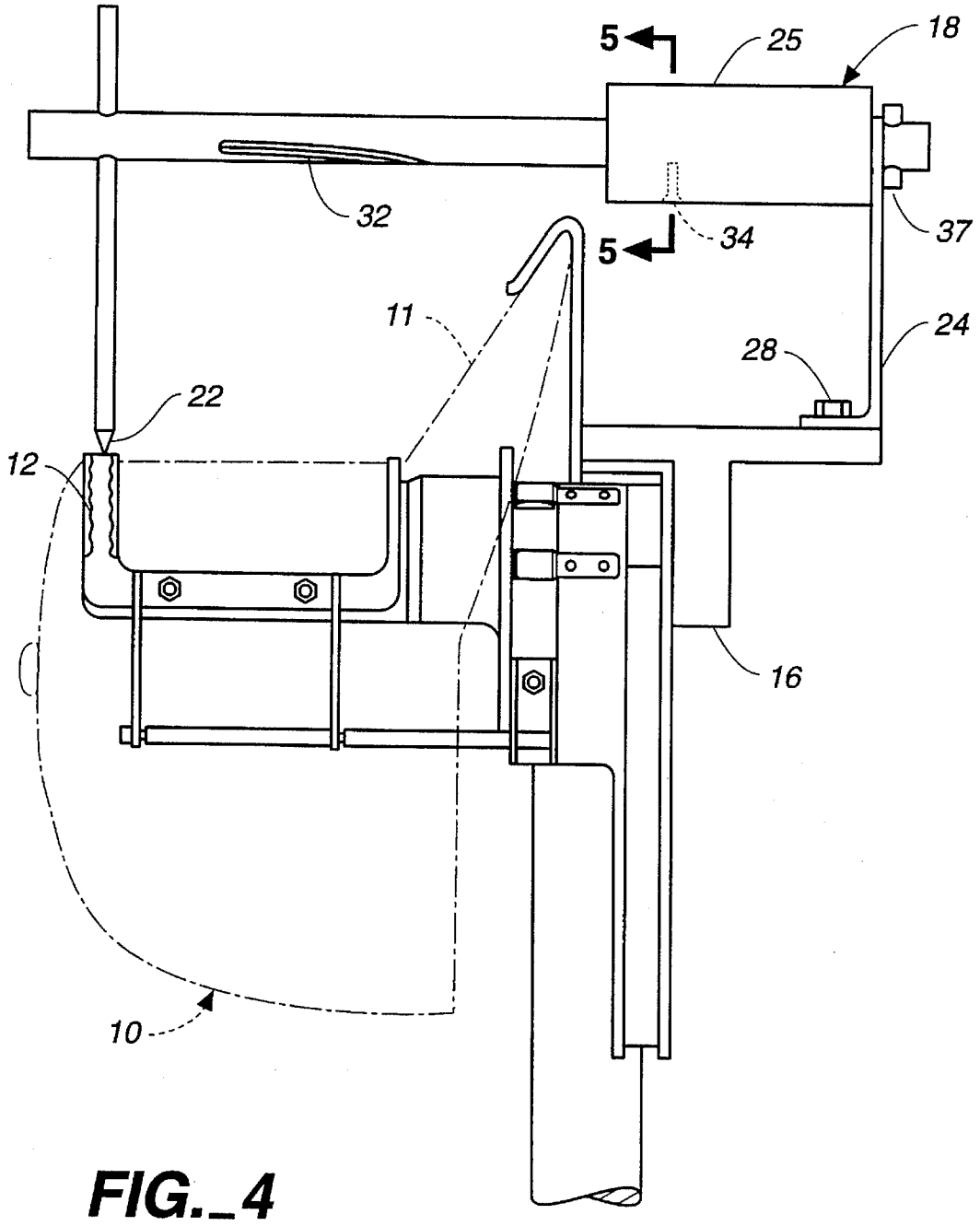
FIG. 4 is a detail view of the cap frame in its position in the receiver, such that the pointer in the extended position indicates the center of the hat. Also detailed is the spiral groove, which causes the rotation of the arm as it tracks the guide screw, located in the support block. The optional stop, the suport block and the alignment stand are also shown in this figure.

The support block 25, comprises a bearing sleeve 27, through which an arm may be drawn, rotating to the positions illustrated in FIG. 3. Arm 31 has a transverse bore through which pointer 22 projects. Rotation of arm 31 is accomplished by means of a guide screw 34, which is threadably engaged in support block 25, and protrudes past the inner diameter of bearing sleeve 27, interacting with slot 32. Rotation of arm 31 in this fashion allows the pointer 22, to avoid interfering with the cap bill 11. With this configuration, the arm 31, and pointer 22, reach the desired position relative to the hat 10, when drawn to the end of slot 32. In FIG. 2B, stop 37, which protrudes transversely through arm 31, can be used in place of slot 32. Ann 31 is drawn toward hat 10, and rotated while against said stop 37, until a ball 35 engages ball detent 36 in arm 31. Ball 35 is biased toward arm 31 by spring 33, and retained by set screw 39, threadably egaged in support block 25, as shown in FIG. 5. The preferred embodiment utilizes the ball detent 36, rather than slot 32.

Figure 6:
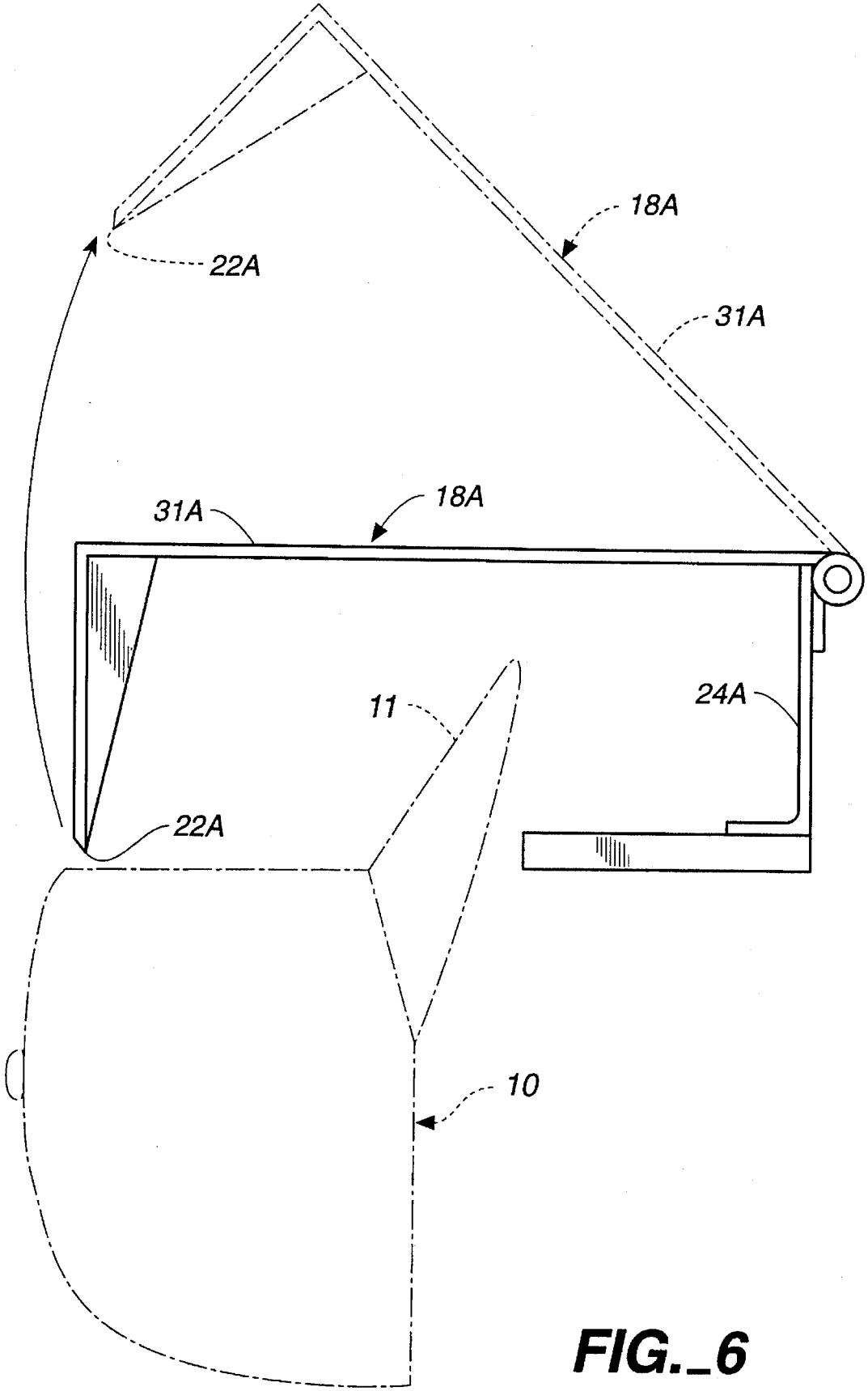
FIG. 6 shows a second embodiment of the invention utilizing a pointer attached to a hinged arm such that the hinged arm is lowered into position over the hat, rather than drawn through a support block as in the previous figures.

An additional embodiment is shown in FIG. 6, showing pointing device 18A, comprising a hinged arm 31A, which is supported by angle bracket 24A. The pointer 22A, rather than being rotated in order to clear the cap bill 11, as in the preferred embodiment, is simply positioned up and out of the way, and is lowered into the predetermined position above the cap 10, to indicate the center of the cap frame 12, so that hat 10 may be positioned accurately.

Figure 8:
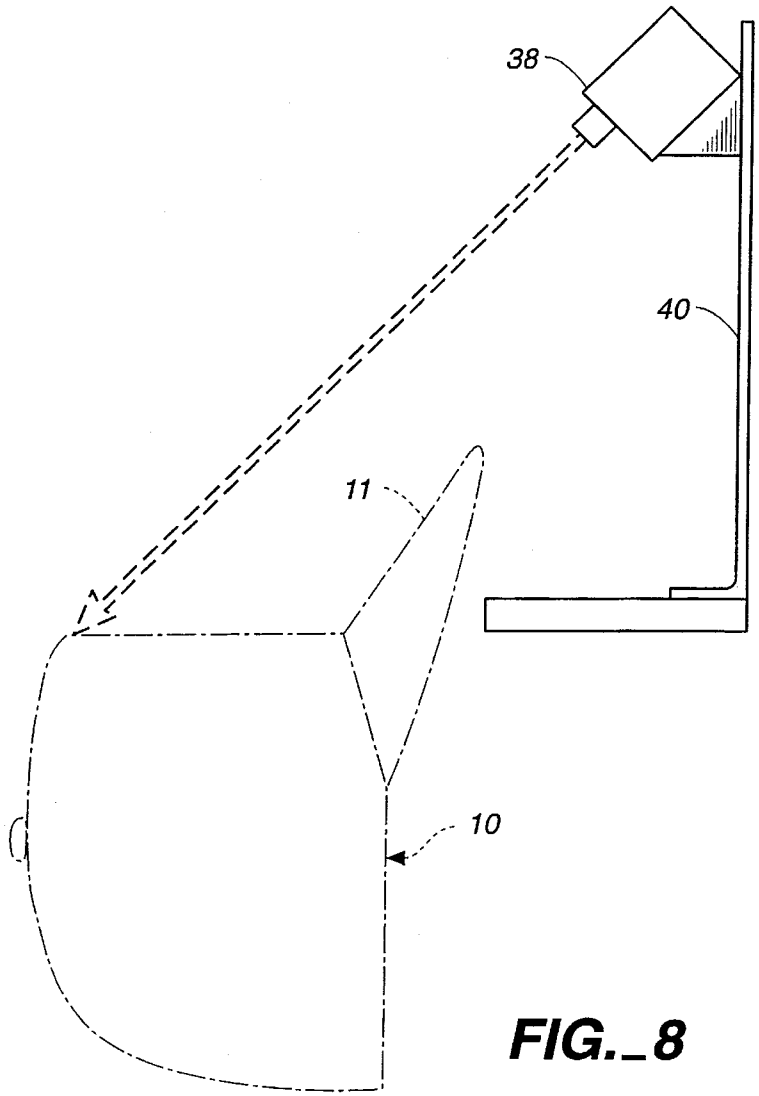
FIG. 8 shows the light emitting device attached to a support arm which is fastened to the alignment stand with an angle bracket as are the other embodiments.
Figure 7:
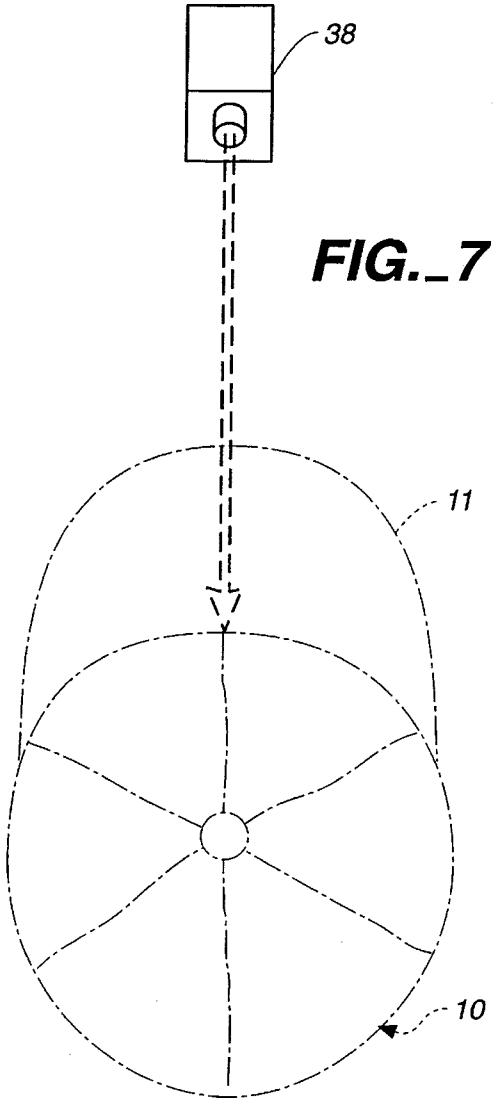
FIG. 7 discloses a third embodiment of the invention utilizing a light emitting device which is positioned such that a light beam indicates the reference for aligning the hat.

FIG. 8 shows a third embodiment substituting a collimated light source 38, such as a laser, in place of the arm 31 and pointer 22 combination. The collimated light source is mounted atop a vertical support 40, providing the preset reference for hat alignment.

I claim:

1. A hat embroidery positioning device comprising:

a base;

a cap setting means;

a first fastening means, attaching said cap setting means to said base;

an indicating means;

a second fastening means for attaching said indicating means to said base such that the center of said cap setting means is identifiable by said indicating means for final positioning of a hat to be embroidered.

2. A hat embroidery positioning device according to claim 1 wherein said cap setting means include:

a cap setting means comprising a receiver and a cap frame mounting bracket.

3. A hat embroidery positioning device according to claim 1 wherein said base comprises:

a vertical member having a flange on one end and a metal plate mounted on the opposite end, said metal plate forming a horizontal shelf.

4. A hat embroidery positioning device according to claim 1 wherein said indicating means include:

angled bracket having a vertical arm and a horizontal arm, said vertical arm forming a semi-circular notch;

a rectangular block having a longitudinal bore and partially threaded first axial bore, said first axial bore emanating from said block's outer surface perpendicular to said longitudinal bore;

a bearing sleeve sized such that the outer diameter of said bearing sleeve contacts the surface of said longitudinal bore, said bearing sleeve extending the length of and firmly affixed to said longitudinal bore, said bearing sleeve forming an opening coincident with said block's first axial bore;

first fastening means for attaching said rectangular block to said bracket with said longitudinal bore concentric to and within said bracket's semi-circular notch;

a first rod having first and second axial through-holes in opposite ends, said first rod sized to slide freely through said bearing sleeve with negligible end-play, said first rod's surface having a ball detent;

a pin extending through said first rod's second axial through-hole;

a ball placed in said first axial bore;

a spring placed in said first axial bore;

a set screw threadably engaged in said first axial bore biasing said spring against said ball such that when said ball detent contacts said ball, said first rod is removably locked into a set position; and a second rod with a conical end extending through said first through-hole, such that when said ball contacts said ball detent, said conical end indicates top-dead-center of said cap setting means.

5. A hat embroidery positioning device according to claim 1 wherein said indicating means include:

an angled bracket having a vertical arm and a horizontal arm, said vertical arm forming a semi-circular notch, said horizontal arm having a cantilever extension perpendicular each to said vertical arm and said horizontal arm;

a rectangular block having a longitudinal bore and partially threaded first axial bore, said first axial bore emanating from said block's outer surface perpendicular to said longitudinal bore;

a bearing sleeve sized such that the outer diameter of said bearing sleeve contacts the surface of said longitudinal bore, said bearing sleeve extending the length of and firmly affixed to said longitudinal bore, said bearing sleeve forming an opening coincident with said block's first axial bore;

first fastening means for attaching said rectangular block to said bracket with said longitudinal bore concentric to and within said bracket's semi-circular notch;, a first rod having first and second axial through-holes in opposite ends, said first rod sized to slide freely through said bearing sleeve with negligible end-play, said first rod's surface having a ball detent;

a pin extending through said first rod's second axial through-hole;

a post secured to said extension, said post projecting in a direction parallel to said first rod;

a ball placed in said first axial bore;

a spring placed in said first axial bore;

a set screw threadably engaged in said first axial bore biasing said spring against said ball such that when said ball detent contacts said ball, said first rod is removably locked into a set position; and a second rod with a conical end extending through said first through-hole, such that when said ball contacts said ball detent, said conical end indicates top-dead-center of said cap setting means.

6. A hat embroidery positioning device according to claim 1 wherein said indicating means include:

an angled bracket having a vertical arm and a horizontal arm, said vertical arm forming a semi-circular notch;

a rectangular block having a longitudinal bore and partially threaded first axial bore, said first axial bore emanating from said block's outer surface perpendicular to said longitudinal bore;

a bearing sleeve sized such that the outer diameter of said bearing sleeve contacts the surface of said longitudinal bore, said bearing sleeve extending the length of and firmly affixed to said longitudinal bore, said bearing sleeve forming an opening coincident with said block's first axial bore;

first fastening means for attaching said rectangular block to said bracket with said longitudinal bore concentric to and within said bracket's semi-circular notch;

a first rod having an axial through-hole, said first rod sized to slide freely through said bearing sleeve with negligible end-play, said first rod's surface forming a slot extending radially along a partial length of said first rod;

a screw threadably engaged in said first axial bore, said screw projecting through said bearing sleeve such that said screw rides within said slot, said screw serving to rotate said first rod when drawn through said block; and a second rod with a conical end extending through said first through-hole, such that when said first rod is drawn the length of said slot toward said cap setting means, said conical end indicates top-dead-center of said cap setting means.

7. A hat embroidery positioning device according to claim 1 wherein said indicating means include:

an angled bracket having a vertical arm and a horizontal arm, said vertical arm forming a semi-circular notch, said horizontal arm having a cantilever extension perpendicular each to said vertical arm and said horizontal arm;

a rectangular block having a longitudinal bore and partially threaded first axial bore, said first axial bore emanating from said block's outer surface perpendicular to said longitudinal bore;

a bearing sleeve sized such that the outer diameter of said bearing sleeve contacts the surface of said longitudinal bore, said bearing sleeve extending the length of and firmly affixed to said longitudinal bore, said bearing sleeve forming an opening coincident with said block's first axial bore; first fastening means for attaching such rectangular block to said bracket with said longitudinal bore concentric to and within said bracket's semi-circular notch;

a first rod having an axial through-hole, said first rod sized to slide freely through said bearing sleeve with negligible end-play, said first rod's surface forming a slot extending radially along a partial length of said first rod;

a post secured to said extension, said post projecting in a direction parallel to said first rod;

a screw threadably engaged in said first axial bore, said screw projecting through said bearing sleeve such that said screw rides within said slot, said screw serving to rotate said first rod when drawn through said block; and a second rod with a conical end extending through said first through-hole, such that when said first rod is drawn the length of said slot toward said cap setting means, said conical end indicates top-dead-center of said cap setting means.

8. A hat embroidery positioning device according to claim 1 wherein said indicating means include:

an angled bracket having a vertical arm and a horizontal arm;

first fastening means for attaching said bracket to said cap setting means;

a collimated light source; and second fastening means for mounting said collimated light source atop said bracket such that said collimated light indicates top-dead-center of said cap setting means.

9. A hat embroidery positioning device according to claim 1 wherein said indicating means include:

an angled bracket having a vertical arm and a horizontal arm;

first fastening means for attaching said bracket to said cap setting means;

a member having a fin on one end; and a hinge connecting said vertical arm to said member such that said member may be lowered with said fin indicating top-dead-center of said cap setting means.

10. A method for positioning a hat prior to embroidering on an automatic sewing machine comprising the steps of:

placing a hat onto a cap setting means;

indicating top-dead-center of said cap setting means;

adjusting said hat such that the center of said hat's surface to be embroidered is coincident with the center of said cap setting means;

locking said hat in position in said cap setting device; and transferring said cap setting means with said hat onto an automatic sewing machine.

* * * * *